US007007585B2

(12) United States Patent
Gonzalez

(10) Patent No.: US 7,007,585 B2
(45) Date of Patent: Mar. 7, 2006

(54) MULTI-HIT TRANSPARENT ARMOR SYSTEM

(75) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 274 days.

(21) Appl. No.: 10/701,411

(22) Filed: Nov. 3, 2003

(65) Prior Publication Data

US 2006/0027090 A1 Feb. 9, 2006

(51) Int. Cl.
*F41H 5/013* (2006.01)

(52) U.S. Cl. ..... 89/36.04; 89/36.01; 109/12; 109/17

(58) Field of Classification Search ..... 89/36.01, 89/36.04, 36.05, 36.07, 36.11, 36.12; 109/11, 109/12, 17, 18
See application file for complete search history.

(56) References Cited

U.S. PATENT DOCUMENTS 1,463,431 A * 7/1923 Neft et al. ..... 160/210
1,544,571 A * 7/1925 Garst ..... 109/8
1,893,459 A * 1/1933 Thomas ..... 109/12
2,009,908 A * 7/1935 Tigert ..... 109/17
2,984,194 A * 5/1961 Jennings ..... 109/4
4,831,939 A * 5/1989 Cardinal ..... 109/17
5,134,943 A * 8/1992 Cardinal ..... 109/17

* cited by examiner

*Primary Examiner*—Michael J. Carone
*Assistant Examiner*—Gabriel Sukman
(74) *Attorney, Agent, or Firm*—David L. Kuhn; Luis Miguel Acosta; Thomas W. Saur

(57) ABSTRACT

A multi-hit transparent armor system is described and claimed herein for improving the resistance of transparent armor to incoming projectiles. Typically, the transparent armor is framed within a window opening of a security structure. An exemplary, contemplated structure is an armored combat vehicle. My system includes a sheet of tempered glass that is also positioned within said window, but is deployed outboard of said transparent armor and is also parallel planar thereto. Positioned below said sheet of tempered glass, and coaxial thereto, is an opaque armor panel that is more efficient and effective against multiple projectiles than either the tempered glass or transparent armor alone. The tempered glass sheet and the opaque armor are typically loaded under compression by a spring assembly. An incoming projectile, launched from a position outboard and also remote from said structure, will first strike the tempered glass before hitting my transparent armor. Thereby, the tempered glass sheet will undergo global failure and is effectively removed from the window opening. In turn, the spring assembly translates the opaque armor into the position formerly occupied by the tempered glass sheet. Subsequently arriving projectiles are then defeated by the opaque armor panel.

6 Claims, 1 Drawing Sheet

MULTI-HIT TRANSPARENT ARMOR SYSTEM

GOVERNMENT INTEREST

The invention described herein may be made, used, and licensed by, or for, the United States Government for governmental purposes without paying me any royalty.

BACKGROUND AND SUMMARY

This invention pertains to transparent armor systems that are subject to multiple hits by small arms fire or other projectiles. In particular, my invention provides an improved armor system for windows of structures and security vehicles that may come under potential attack by terrorists or assailants.

In the general field of ballistic armors, it is widely accepted that transparent armor plate (bullet-resistant glasses) will be used for windows of security vehicles and structures. These glasses are well known in the art and are commercially available from a variety of worldwide vendors.

The principal problem with transparent armors is that they generally incorporate glass or ceramic materials as major construction materials. These materials are either very brittle or have limited ability to withstand multiple impacts or hits from small arms projectiles. The initial impact on such materials often causes wide spread damage over a large surface area, and leaves them highly vulnerable to subsequent impacts. Thereby, an assailant may defeat a transparent armor system merely by firing into it until the accumulative damage renders the armor system ineffective. Because most modern infantry rifles have magazine capacities approaching 30 rounds, or more, this is a serious problem with sufficient risk to defeat most transparent armor systems.

My invention remedies the above mentioned vulnerability of transparent armors by the rapid deployment of an opaque armor panel after a first projectile is fired or propelled at my transparent armor system. This will be readily achieved herein by my parallel positioning of a sheet of tempered glass that is outboard of said transparent armor plate, which has the same dimensions and fits the same window opening of a structure as the transparent armor.

The tempered glass sheet functions therein as a protective cover and as a sacrificial element or sensor. When a first projectile is fired at the window by an assailant, the tempered glass will be subjected to loss of structural integrity or global failure upon impact. Depending upon its energy loss, the initial projectile may, or may not, strike the parallel planar, transparent armor plate. In effect, this event will remove the tempered glass sheet from the window opening. Then, a spring assembly, which is loaded under compression and is located under the lower edge of the opaque armor panel, will respond to the event by translating said panel through conforming guides, attached to or formed within the structure or security vehicle, to the formerly occupied position of said glass sheet. Preferably, said translation will occur in less time than the cycle rate of the threat weapon to afford maximum security.

Thereafter, said opaque armor panel will be parallel with said transparent armor plate and will protect it from any subsequently arriving projectiles. The invention as described and claimed herein is thus both efficient and effective for resisting multiple impacts from subsequently arriving projectiles. Preferably, the opaque armor panel will also be provided in the form of a shutter, or with similar means of visibility, such as view ports and slots. Occupants will thereby have the opportunity to evaluate the intent and number of assailants, the type of threat weapori, and suitable defensive measures such as escape routes.

DETAILED DESCRIPTION

Figure 2:
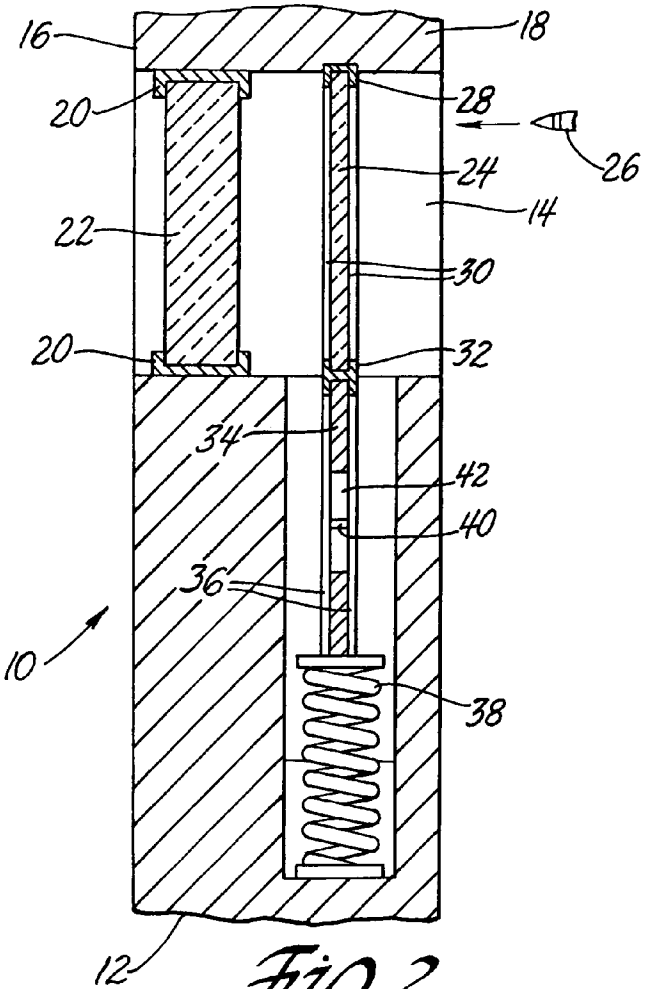
FIG. 2 is a sectioned, side view of FIG. 1 taken along the line 2—2, showing the interrelationships of the components of this invention.
Figure 1:
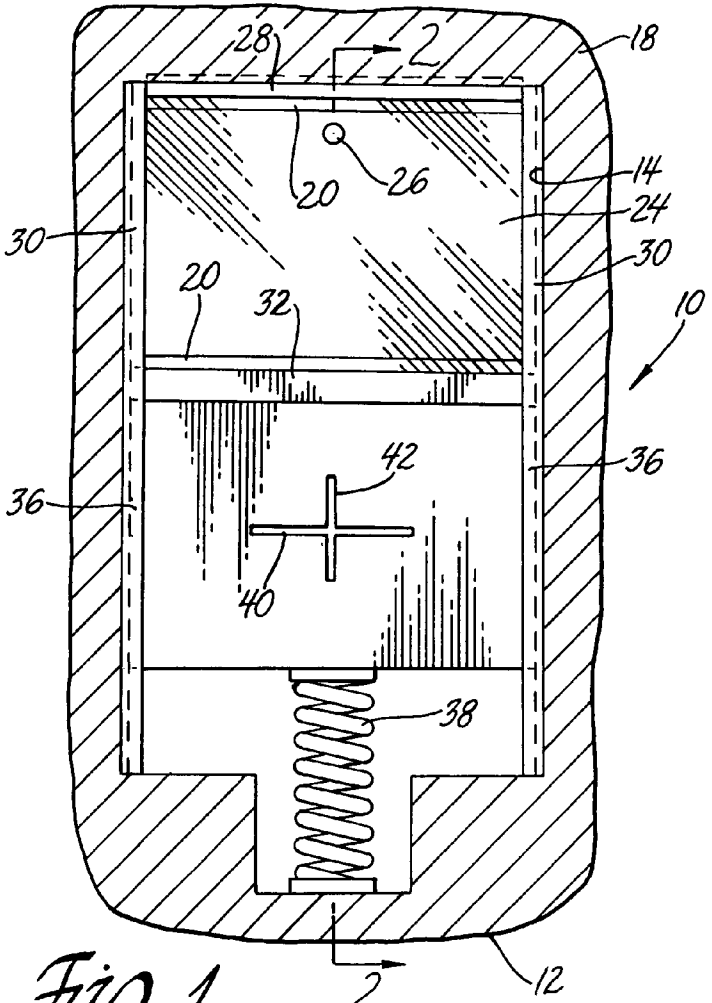
FIG. 1 is a partially sectioned view taken from a point outside of a security structure wherein my invention has been installed.

According to my invention, and referring to FIGS. 1 and 2, there is shown therein my window armor system 10 which has been installed within a security vehicle (not fully shown). FIG. 2 to is a sectioned, side view of FIG. 1 taken along line A—A. While the right-side wall 12 of a security vehicle is depicted in FIG. 2, it should be apparent that the left-side wall (not depicted) will be an exact mirror image of FIG. 2. Moreover, it should be appreciated that wall 12 could also be part of a building, or like structure, that provides ballistic protection for occupants.

A windowed opening 14 within wall 12 completely extends from an inboard or inner side 16 of said wall to an outboard or exposed side 18. Positioned within opening 14 near the inner side 16 are channeled frame(s) 20 that hold a transparent armor plate 22. While this plate is shown herein as a unitary, homogenous structure, it will be appreciated by those skilled in the art that this plate can be formed of multiple sheets of differing transparent materials which have been laminated together. It should also be understood that window opening 14 could be a windshield or rear window opening of a security vehicle.

It is also contemplated herein that plate 22 is a standard transparent armor which is designed to withstand one or more impacts from a designated threat weapon. Examples of suitable transparent armors are bullet-resistant glasses, such as glass-polyurethane, glass-polycarbonate, and glass-acrylic laminates. Alternatively, combinations of these laminates may also be used. Suitable glasses or laminates of this type are generally known in the art. Specific reference is made to my copending, continuing application of U.S. Ser. No. 10/117,556 that was originally filed on Apr. 24, 2002 for further information.

Also positioned within opening 14 is an outer cover 24 comprising a tempered glass sheet that is disposed outboard of plate 22 and is parallel planar therewith. It is to be understood that said cover 24 is generally confined between its top and bottom edges by retention channels defined by upper horizontal frame member 28 and double-channeled horizontal frame member 32. Frame member 28 provides a downwardly open channel for receipt of at least a portion of the top edge of cover 24 and double-channeled horizontal frame member 32 provides an upwardly open channel for receipt of at least a portion of the cover's bottom edge. It is to be further understood herein that the opposing sides of cover 24 fit loosely within parallel, vertical guides 30. It is also contemplated that said frame members 28 and 32; and said vertical guides 30 can be affixed to, or formed within, the security vehicle or structure by placement of conforming grooves or tracks that will fit around the edges of said outer cover 24 and within the inner periphery of the windowed opening 14. The exact sizes and shapes of these members, guides, and grooves will be determined by cost engineering studies during a design and analysis for fabrication in commercial quantities of this armor system.

When the outer cover 24 is stuck by a projectile 26, such as a bullet from an infantry rifle, it will shatter, collapse, and/or totally fail. Again, subject to cost engineering studies for commercial production, it is possible that a small cavity (not shown) could be formed within right side wall 12 at the bottom or top of the windowed opening to accommodate any debris or glass shards that might remain within the vertical guide members. This precaution would preclude any potential interference with the translation of the opaque armor panel 34.

Also situated within wall 12 is a plate-shaped, opaque armor panel 34 that extends below outer cover 24 and has dimensions which are substantially identical to said cover. While this panel is depicted in FIG. 2 as a homogeneous structure, it can also be a laminated structure with multiple layers of metals and/or ceramics to provide an even greater degree of protection. This panel 34 is held within the same plane as outer cover 24, but is directly beneath said cover. Preferably, panel 34 will have at least one slit, like horizontal slit 40, vertical slit 42, or all variations thereof, as generally depicted in FIG. 1 as a cross. Also, the opaque armor panel can be provided with similar means for achieving occupant visibility including the well-known forms of a shutter, louver, multiple perforations, and view ports and slots. Ideally, the dimensions of these openings within the armor panel should be less than the diameter of the smallest threat projectile.

A first (top) edge of this opaque armor resides within the downwardly open (second) channel of the double-channeled horizontal frame member 32. The adjoining (side) edges of panel 34 fit loosely and slideably in parallel, vertical guides 36, which can optionally be replaced by grooves or tracks as above in paragraph [0013]. A second (bottom) edge of panel 34 rests upon a compressed, spring assembly 38 that loads said panel 34, and said outer cover 24 under compression. Thereby, these components are retained mechanically in their assembled position as depicted in FIG. 2. Known devices other than a spring assembly which can exert compressive forces on the above mentioned components include pneumatic or hydraulic cylinders.

As an alternate embodiment of this invention, an electric sensor, such as a conductive electric grid, can also be utilized in the windowed opening 14 to detect an incoming projectile 26. Then an electric actuator, such as a solenoid, will either translate or otherwise activate the opaque armor panel 34 into a parallel planar position, outboard of the transparent armor plate 22 to protect it from projectile impact. Another alternate embodiment of this invention can use a series of opaque armor panels, properly hinged, to fold or roll into a folded or coiled position for deployment.

I wish it understood that I do not desire to be limited to the exact details of construction or method shown herein since obvious modifications will occur to those skilled in the relevant arts without departing from the spirit and scope of the following claims.

What is claimed is:

1. In a structure having one or more exposed sides with at least one window opening within a side for occupant viewing, an armor system of improved ability is provided to prevent projectile passage through said opening, the armor system comprising:

a. a plate of transparent armor within said opening;

b. a cover of transparent material within the opening remote from said plate and closer to the exposed side than said plate;

c. wherein said cover fails globally when struck by a projectile launched at said cover by a threat weapon;

d. an opaque armor panel coaxially positioned below said cover and within a common plane;

e. means for connecting said panel with said cover; and f. means at the lower edge of said panel for translating the panel toward the position of said cover within the opening.

2. The armor system of claim 1 wherein the structure is a security vehicle.

3. The armor system of claim 1 wherein the cover is a sheet of tempered glass.

4. The armor system of claim 1 wherein the translating means is selected from the group consisting of a spring assembly, a hydraulic cylinder, and a pneumatic cylinder.

5. In a structure having an exposed wall with a window opening through said side for occupant viewing, an armor system of improved ability is provided to defeat passage of a succession of projectiles through said opening, the armor system comprising:

a. a transparent armor plate within said opening remote from said exposed wall;

b. a cover of transparent material within the opening remote from said plate and closer to the exposed wall than said plate;

c. wherein said cover fails globally when struck by a projectile launched at said cover by a threat weapon;

d. an opaque armor panel coaxially positioned below said cover and within a common plane;

e. means for connecting said panel with said cover;

f. means at the lower edge of said panel for translating the panel toward the position of said cover within the opening;

g. panel edges adjacent to the lower edge of said panel; and h. means at said panel edges for guiding the panel toward the position of the cover in the opening.

6. The armor system of claim 5 wherein the guiding means comprises vertical guides disposed along peripheral edges of the panel.

* * * * *